US005138122A

United States Patent [19]

Moldovan et al.

[11] Patent Number: 5,138,122

[45] Date of Patent: Aug. 11, 1992

[54] BI-DIRECTIONAL DIRECT CURRENT SWITCHING APPARATUS HAVING ARC EXTINGUISHING CHAMBERS ALTERNATIVELY USED ACCORDING TO POLARITY APPLIED TO SAID APPARATUS

[75] Inventors: Peter K. Moldovan, Cascade; Mark A. Juds, New Berlin; Robert A. Kihn, Menomonee Falls, all of Wis.

[73] Assignee: Eaton Corporation, Cleveland, Ohio

[21] Appl. No.: 574,839

[22] Filed: Aug. 29, 1990

[51] Int. Cl.[5] ..... H01H 33/04

[52] U.S. Cl. ..... 200/144 R; 200/147 R; 200/147 A

[58] Field of Search ..... 200/144 R, 147 R, 147 A, 200/144 C; 335/234

[56] References Cited

U.S. PATENT DOCUMENTS

| | | | |
|---|---|---|---|
| 2,506,991 | 5/1950 | Brown | 200/147 A |
| 2,919,324 | 12/1959 | Schuessler | 335/137 |
| 2,945,109 | 7/1960 | Fehling | 200/147 R |
| 3,022,450 | 2/1962 | Chase, Jr. | 361/194 |
| 3,040,217 | 6/1962 | Conrad | 335/234 |
| 3,090,854 | 5/1963 | Kretzschmar | 200/147 |
| 3,814,376 | 6/1974 | Reinicke | 251/65 |
| 4,082,931 | 4/1978 | Hayes | 200/144 C |
| 4,404,443 | 9/1983 | Coynel et al. | 200/147 A |
| 5,004,874 | 4/1991 | Theisen et al. | 200/144 R |

*Primary Examiner*—Bernarr E. Gregory
*Attorney, Agent, or Firm*—L. G. Vande Zande

[57] ABSTRACT

Direct current switching apparatus having two arc extinguishing chambers located in a common transverse plane, one chamber being divided into separate laterally spaced portions disposed below the other chamber, a pair of spaced conductors each having a contact element and an arc runner extending from near the contact, the arc runners being curved and disposed in a convex mirror-imate relationship to each other between the laterally spaced portions, distal ends of each arc runners providing a divergent path into the other chamber, a conductor disposed at outboard sides of the laterally spaced arc chamber portions cooperating with concave sides of the arc runners to provide divergent paths into the spaced arc chamber portions, power supply terminals connected to the respective spaced conductors, magnetic plates disposed in front and in back of the arc chambers having portions providing a magnetic path externally around the chambers, permanent magnets magnetically coupled to at least one of the magnetic plates providing a magnetic field in the plates and across the arc chambers in a forward direction, a movable contact movable normal to the forward direction into and out of bridging engagement with the stationary contact elements, and an electromagnetic drive motor disposed coextensive with the arc extinguishing chambers, coupled at a lower end to the movable contact. Arcs established between the stationary and movable contact elements are moved from the contacts into either arc extinguishing chamber by the magnetic field coacting with current in the arc to generate forces which move the arc.

25 Claims, 7 Drawing Sheets

4
6
84a
82a
50b
8
20
8b
8c
48
18
50
52
50a
28
84
88
82e
5
28k
50a
16
5
82
52
30
56
16a
62a
16b
90
58
17
96
84b
50c
62b
16c
94
82c
8c
48
120
34
102g
102
118
50d
108
114
110a
34a
116
8b
20
12

BI-DIRECTIONAL DIRECT CURRENT SWITCHING APPARATUS HAVING ARC EXTINGUISHING CHAMBERS ALTERNATIVELY USED ACCORDING TO POLARITY APPLIED TO SAID APPARATUS

CROSS REFERENCE TO RELATED APPLICATIONS

This invention is related to copending U.S. patent application Ser. No. 07/435,228 entitled "Direct Current Switching Apparatus" filed Nov. 12, 1989 in the names of Peter J. Theisen, Daniel A. Wycklendt, Mark A. Juds and Peter K. Moldovan, now U.S. Pat. No. 5,004,874, issued Apr. 2, 1991. This application is also related to copending U.S. patent application Ser. No. 07/574,702, entitled "Bi-directional Direct Current Switching Apparatus Having Bifurcated Arc Runners Extending Into Separate Arc Extinguishing Chambers" filed Aug. 29, 1990 in the names of Peter K. Moldovan, Peter J. Theisen, Mark A. Juds and Robert A. Kihn. Both of the above mentioned applications are assigned to the assignee of this application.

BACKGROUND OF THE INVENTION

This invention relates to apparatus for switching direct current (DC) electric power. More particularly it relates to apparatus of the aforementioned type which is non-polarized or bi-directional, i.e. its performance is independent of polarity of the current at the power terminals, and can switch high voltage DC power. Still more particularly, the invention is related to apparatus of the aforementioned type which is compact, lightweight, may be hermetically sealed and can switch high voltage DC power at high altitude.

High voltage DC power is one of the most efficient, reliable and lightweight methods to generate and distribute energy. Development of high torque samarium cobalt brushless DC motors has resulted in low weight alternatives to hydraulic actuators used in weight and reliability-sensitive applications, e.g. aircraft. However, difficulties in switching high voltage DC power, particularly at high altitude, and the weight and volume of conventional DC switching apparatus capable of quenching high voltage circuits at altitudes, preclude the use of such switching apparatus in aircraft. As a result, the inability to satisfactorily switch high voltage DC power at altitude has delayed use of this power in aircraft.

SUMMARY OF THE INVENTION

It is an object of this invention to provide improved DC switching apparatus.

It is a further object of this invention to provide DC switching apparatus capable of switching high voltage DC power.

It is a further object of this invention to provide DC switching apparatus which is non-polarized.

It is a further object of this invention to provide DC switching apparatus capable of switching high voltage DC power at high altitude.

It is still a further object of this invention to provide DC switching apparatus capable of switching high voltage DC power at high altitude, which apparatus is compact and lightweight.

It is still a further object of this invention to provide DC switching apparatus of the aforementioned type which is economically and efficiently manufactured.

This invention provides bi-directional DC switching apparatus comprising a central arc extinguishing chamber and a pair of laterally spaced arc extinguishing chambers, a pair of spaced conductors each having a stationary contact and an arc runner leading from the contact in a generally bowed configuration arranged with convex sides of respective arc runners facing each other and distal ends of said arc runners diverging into the centrally located arc extinguishing chamber, conductive means disposed at outboard sides of the conductors, the conductive means and respective associated arc runners diverging into respective ones of the laterally spaced arc extinguishing chambers, a movable contact, drive means operable to move the movable contact into and out of bridging engagement with the stationary contacts, and means providing a magnetic field across the switching apparatus in regions comprising the stationary contacts and arc runners, the magnetic field being directed substantially normal to movement of the movable contact and co-acting with current in electric arcs drawn between the stationary and movable contacts upon separation to generate forces which assist movement of the arcs in predetermined directions away from the stationary contacts into respective arc extinguishing chambers, and means for connecting DC power to the spaced conductors wherein polarity of the power applied to the conductors determines whether the arc is moved into the centrally located arc extinguishing chamber or into the pair of laterally spaced arc extinguishing chambers.

This invention further provides an electromagnetically operated linear motor for driving the movable contact, the motor being provided with a magnetic frame which is blanked from magnetic material and shaped to provide a single-piece magnetic frame for the motor, the frame also providing mounting tabs for the motor and structural features which cooperate with molded coil bobbins and other elements of the motor for alignment and retention of the respective motor parts.

The foregoing and other features and advantages of this invention will become more readily apparent and understood when reading the following description and appended claims in conjunction with the accompanying drawings.

DETAILED DESCRIPTION OF THE PREFERRED EMBODIMENT

Figure 1:
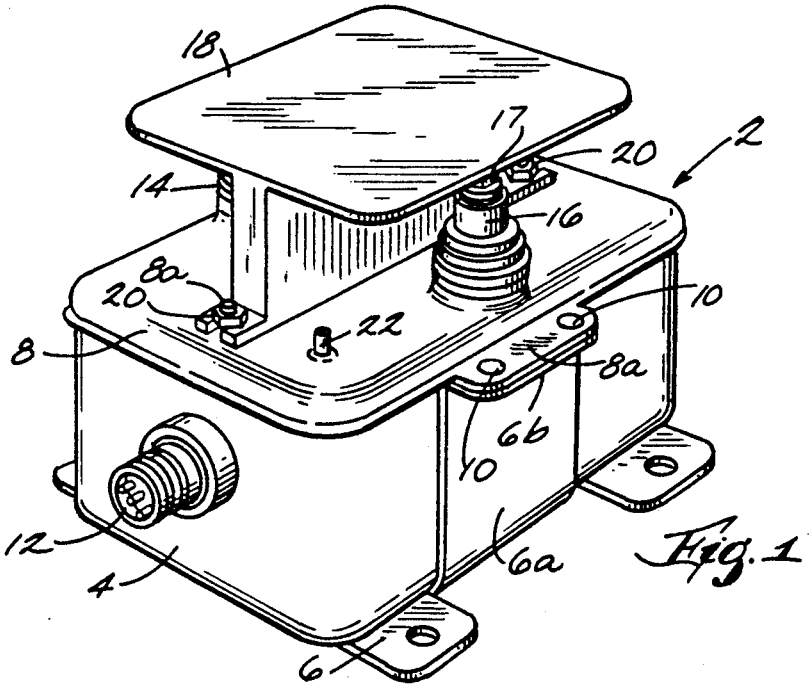
FIG. 1 is a perspective view of a hermetically sealed electromagnetic contactor comprising the bi-directional DC switching apparatus of this invention oriented, for purposes of the following description only, on its backside with a front side disposed upward and a multipin connector extending from a bottom side thereof.

With reference to FIG. 1 of the drawings, a hermetically sealed electromagnetic contactor 2 incorporating the bi-directional DC switching apparatus of this invention is shown in perspective. The contactor 2 comprises an outer metal envelope comprising a can 4 having a mounting plate 6 affixed to the back thereof by welding or the like and a header 8 hermetically welded over an open front side of can 4. Directional references herein, such as "front", "rear", "top", "bottom" and the like, are illustrative only for convenience and clarity in description, and are not to be construed as limitations to the scope of the invention defined in the appended claims. As a reference for the term "compact" as used herein, the envelope comprising can 4 and header 8 may be on the order of 3.42 inches wide by 5.00 inches long by 3.23 inches high. Header 8 has outwardly projecting flanges 8*a* extending from opposite lateral edges. Mounting plate 6 has forwardly extending straps 6*a* at opposite lateral sides, the free ends of which terminate in laterally projecting flanges 6*b* secured to flanges 8*a* by fasteners 10.

A multipin connector 12 is hermetically attached within an opening in a bottom wall of can 4 to provide connection to control electronics (not shown) for the switching apparatus within the envelope. DC power terminals 14, 16 are attached and hermetically sealed to header 8, electrical insulated therefrom, to extend through the header. The externally projecting cylindrical body portions of terminals 14, 16 have tapped holes for receiving screws 17 which attach power conductors (not shown) to the terminals. A generally T-shaped insulating barrier 18 is attached to header 8 by a pair of nuts 20 which threadably engage threaded posts 8*b* welded to the exterior of header 8. Barrier 18 isolates the power terminals 14, 16 and the respective attached conductors from each other and provides a protective cover thereover to reduce electrical shock hazard. Header 8 is also provided with a tubular fitting 22 through which the seal of the contactor assembly may be checked and the contactor may be evacuated and filled with a controlled atmosphere medium such as an inert gas or the like, after which the fitting 22 is crimped shut and sealed.

The bi-directional DC switching apparatus is represented generally by the reference numeral 24. A linear electromagnetic drive motor for the switching apparatus is represented generally by the reference numeral 26. These two elements of the invention are assembled together and to the interior of header 8 prior to assembly of the external can 4 to header 8.

Figure 9:
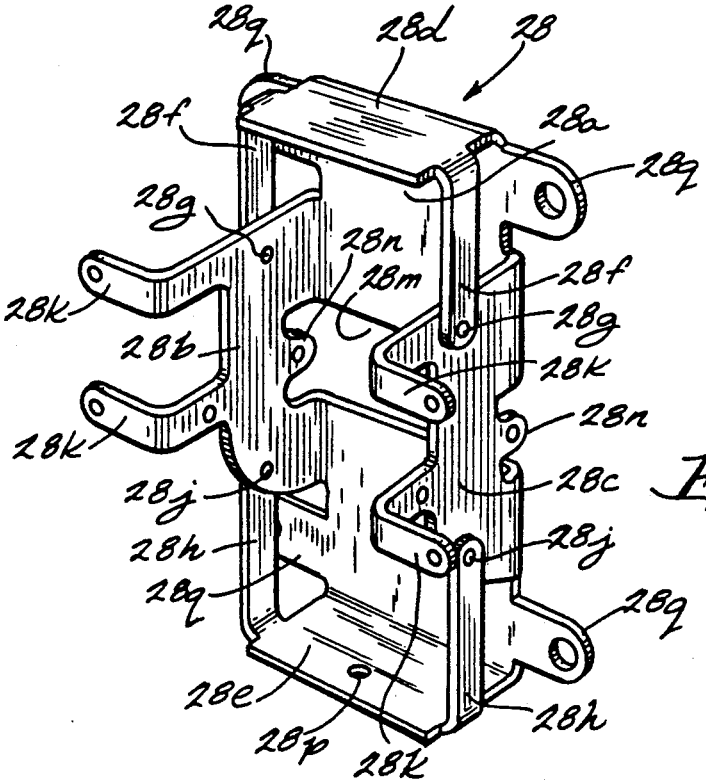
FIG. 9 is a perspective view of a magnetic frame for a linear magnetic motor which drives the movable contact of the switching apparatus of this invention.

A primary component of motor 26 is a single-piece magnetic frame 28 shown individually in perspective view in FIG. 9. Frame 28 is preferably blanked from a sheet of magnetic material such as magnet iron and subsequently formed to a generally rectangular open box-like shape to receive other elements of the motor. Frame 28 consists of a body 28*a* having opposite sides 28*b* and 28*c*, a top 28*d* and a bottom 28*e* all formed at right angles to the body 28*a*. Top 28*d* has a pair of fingers 28*f* projecting from opposite lateral sides, the fingers 28*f* being formed downwardly at right angles to top 28*d* and joined to respective sides 28*b* and 28*c* by rivets 28*g*. Similarly, bottom 28*e* has a pair of fingers 28*h* extending laterally therefrom, the fingers being formed upwardly at right angles to bottom 28*e* and joined to respective sides 28*b* and 28*c* by rivets 28*j* to provide increased strength for the frame. Sides 28*b* and 28*c* each have a pair of projecting fingers which are bent perpendicularly to the respective sides to provide outwardly extending lateral flanges 28*k*, each having a hole therein. The body 28*a* of frame 28 is provided with a central opening 28*m* which extends into the respective sides 28*b* and 28*c*. Tabs 28*n* are formed integral and coplanar with sides 28*b* and 28*c* and extend forwardly within the opening 28*m*. Each of the tabs 28*n* is provided with a hole therethrough as is the lower finger of the respective sides to receive screws 30 (FIGS. 4 and 5) therethrough which in turn receive nuts 32 at the respective projecting ends. Screws 30 provide a clamping force to the motor assembly as will be described hereinafter. Bottom 28*e* is provided with a hole 28*p* through which a drive rod 34 extends to attach to a plunger 36 of the outwardly directed tabs 28*q* which are each in the plane of the body 28*a* and each of which are provided with a hole therethrough.

Figure 4:
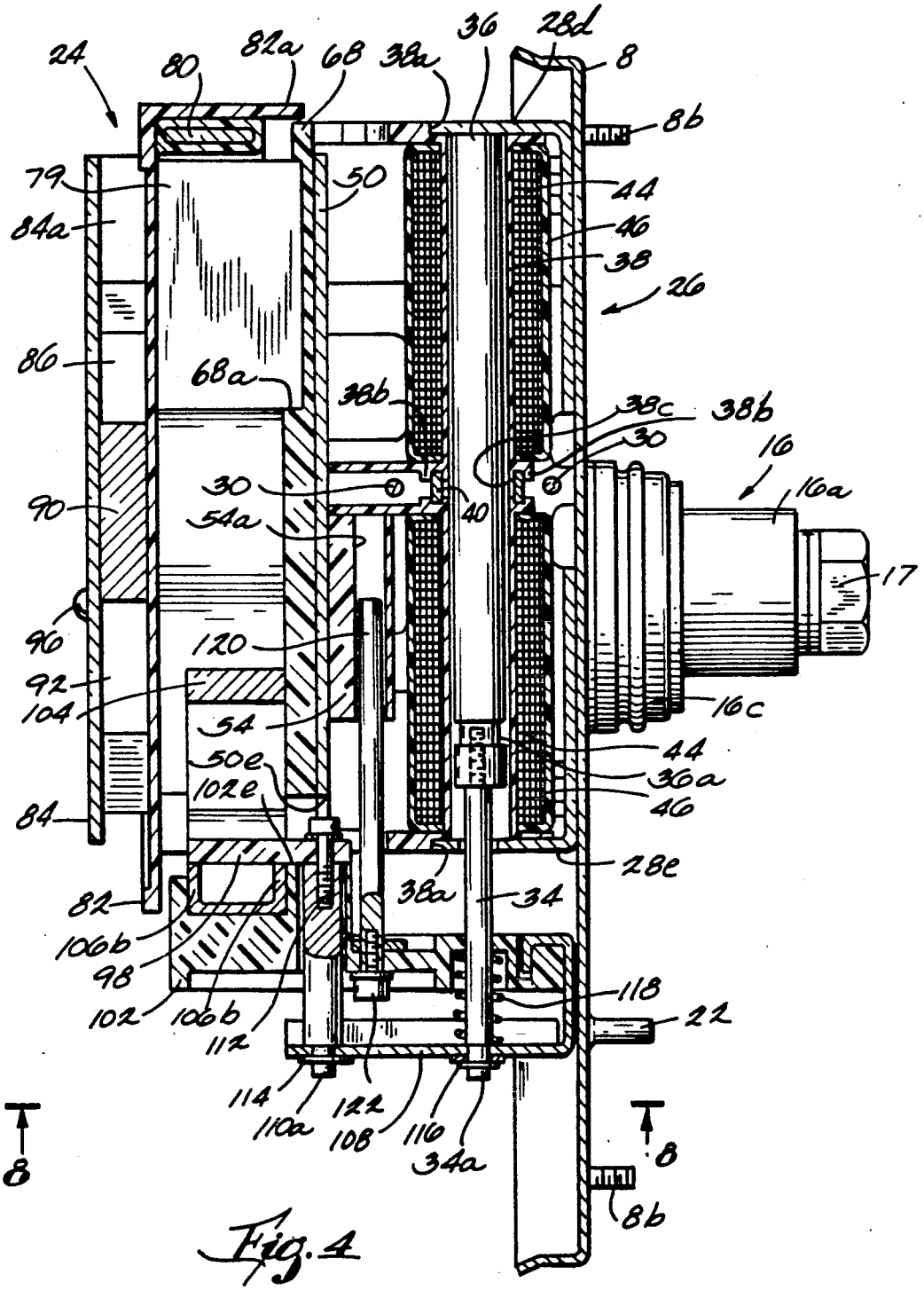
FIG. 4 is a cross section of the bi-directional DC switching apparatus of this invention removed from the contactor outer envelope taken generally along the line 4—4 in FIG. 2.
Figure 5:
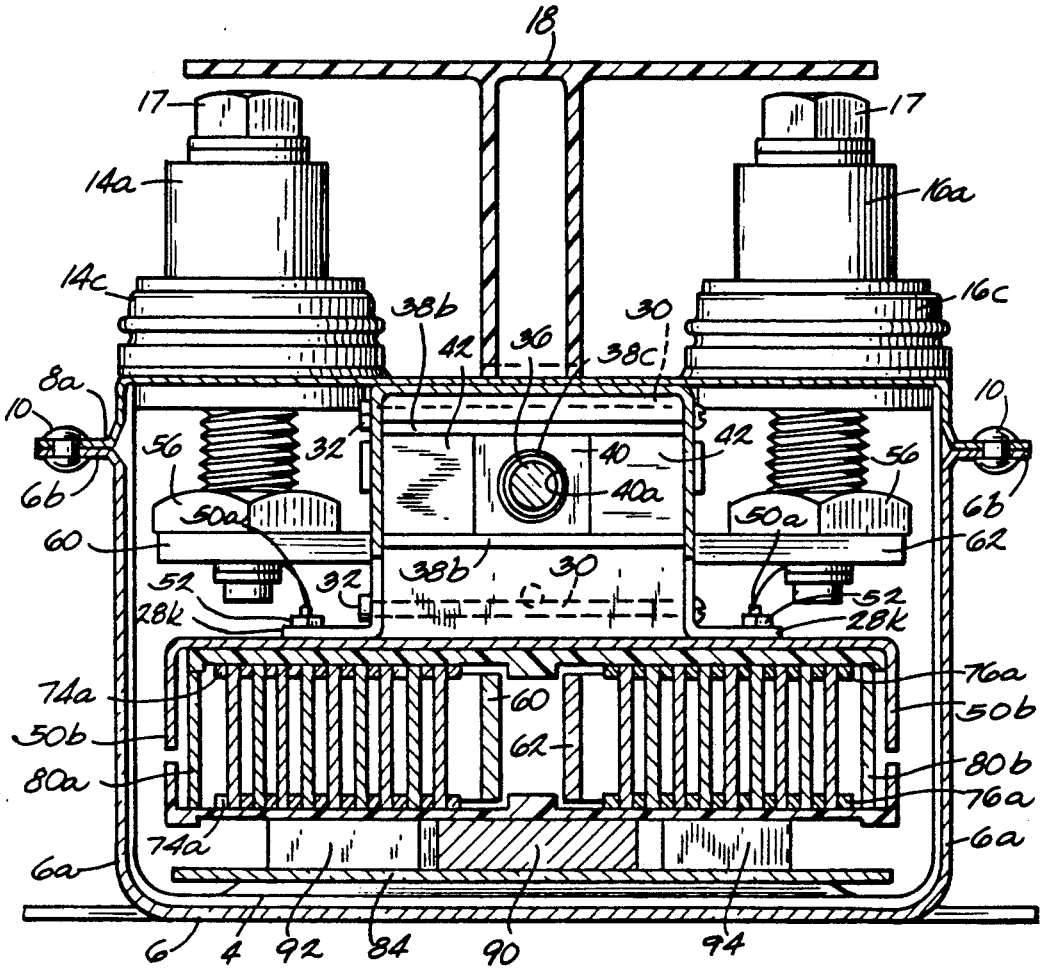
FIG. 5 is a transverse cross section of the contactor of FIGS. 1-3 taken generally along line 5—5 in FIG. 3.

Motor 26 further comprises a pair of molded plastic bobbins 38 which are disposed in opposite end-to-end coaxial relationship between top 28*d* and bottom 28*e* of frame 28 (FIG. 4). The flanges of bobbins 38 which are adjacent 38*a* which abuts the rear edge of the respective top and bottom members of frame 28 to provide non-rotational positioning for the coils relative to the frame. The flanges of coils 38 which are mutually adjacent each other at the center of motor 26 are provided with spaced pairs of laterally extending raised ridges 38*b* (FIG. 4) and a raised circular ring 38*c* coaxial with the openings through the bobbins and disposed between the respective ridges 38*b*. Rings 38*c* of the respective bobbins project part way into a hole 40*a* in a magnetic flux concentrator 40. The magnetic flux concentrator 40 comprises a rectangular plate which is non-rotatably disposed between the raised ridges 38*b* (FIGS. 4 and 5). Also disposed between ridges 38*b* is a pair of permanent magnets 42 located on opposite sides of flux concentrator 40. The overall lateral dimension of permanent magnets 42 and flux concentrator 40 is substantially identical to a lateral dimension between sides 28*b* and 28*c*. Screws 30 and nuts 32 serve to clamp the permanent magnets 42 and flux concentrator 40 firmly together and firmly between the sides 28*b* and 28*c* to minimize any air gap between these elements. Inasmuch as the raised rings 38*c* of each bobbin project into the common hole 40*a* of flux concentrator 40, coaxial alignment of the interior ends of the bobbins is readily achieved. Plunger 36 is loosely disposed within the central openings of bobbins 38 for guided axial reciprocal movement therein. The lower end of plunger 36 is undercut at 36*a*, the undercut serving as a flux restrictor to reduce magnetic flux, and hence magnetic latching strength, at the lower end of plunger 36 below the flux and latching strength at the upper end of plunger 36. This imbalance in latching strength is also contributed to by the relatively small sealing surface area at the lower end of plunger 36 and periphery of hole 28*p*. Plunger 36 is also provided with an axial threaded opening at its lower end for receiving drive rod 34 as will be described hereinafter. Identical coils are wound on bobbins 38 and are provided with an insulating covering 46 around the exterior thereof. By mismatching the magnetic latching strength at the opposite ends of the motor and plunger 36, identical coils may be used to drive the plunger, thereby effecting a cost advantage. In the up position of the plunger, the contacts are closed, compressing a contact pressure spring 118 as will be described later. Thus the spring assists the respective coil in driving the plunger downward. In the down position the spring is not active, but with less latching strength present, the identical coil can drive plunger 36 upward.

Figure 3:
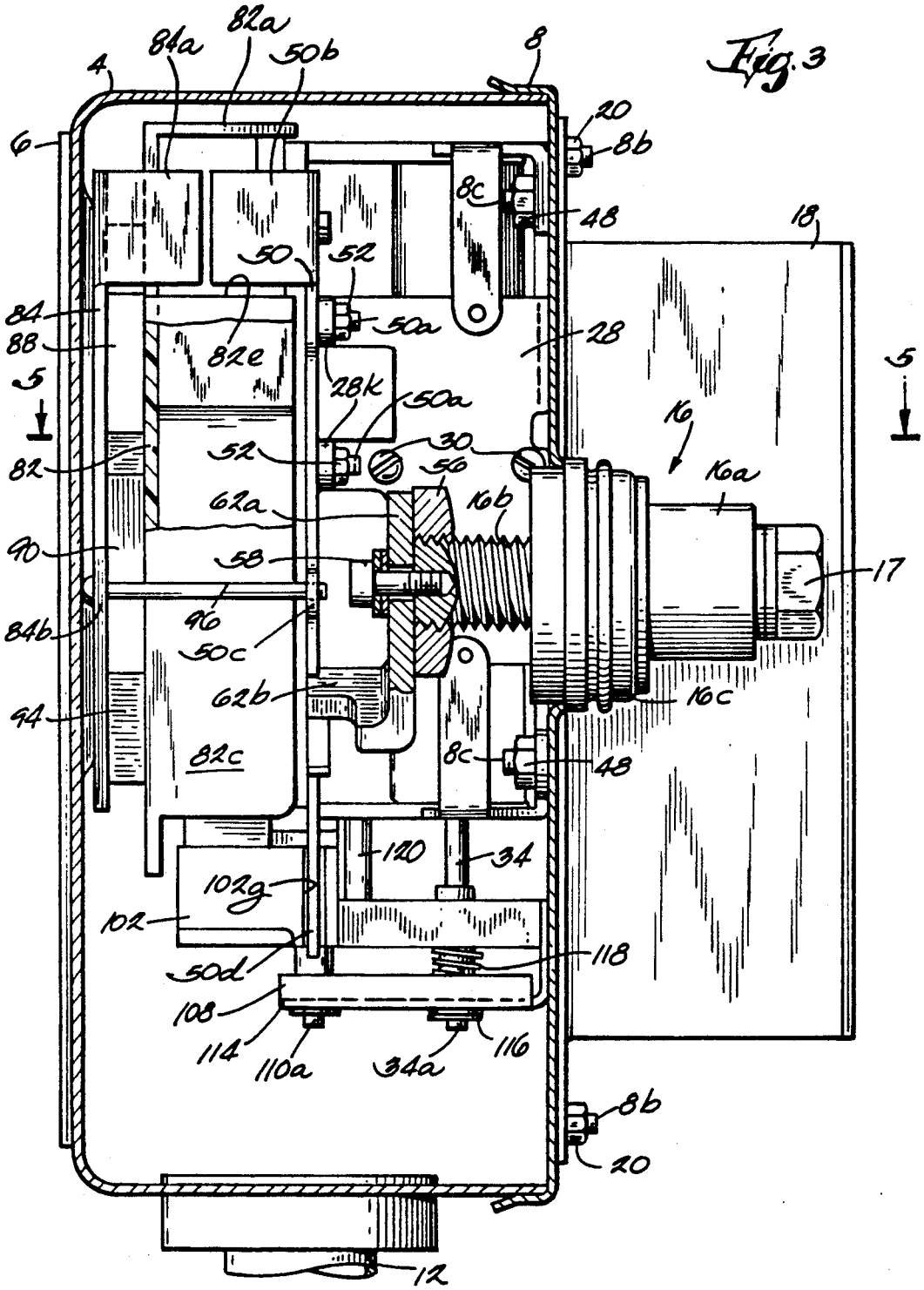
FIG. 3 is a cross section of the contactor of FIGS. 1 and 2 taken generally along the line 3—3 in FIG. 2.
Figure 8:
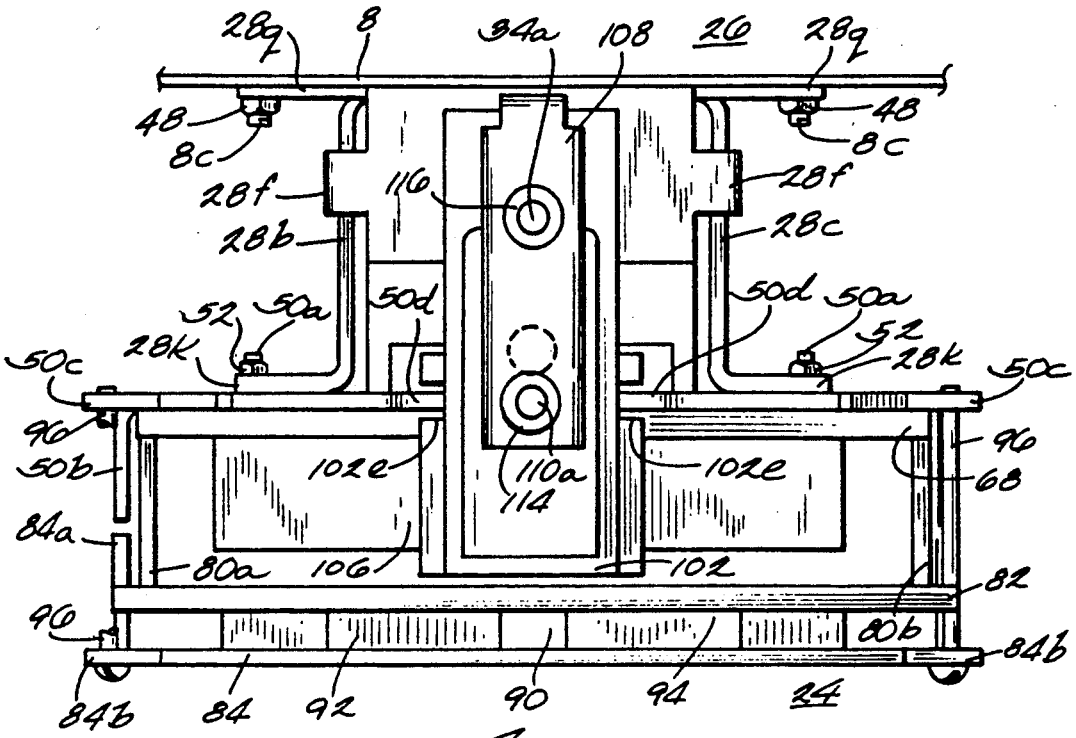
FIG. 8 is a bottom view of the switching apparatus taken along the line 8—8 in FIG. 4.

With the components of the motor 26 positioned and clamped within the frame 28 as aforedescribed, drive rod 34 is inserted through hole 28*p* and is threaded into the lower end of plunger 36. The motor 26 is then attached to the interior of header 8. The header is provided with a rectangular array of rearwardly projecting threaded posts 8*c* (FIGS. 3 and 8). Tabs 28*q* are disposed over posts 8*c* and the motor is secured against the header by nuts 48 threaded onto the posts 8*c*.

A front magnetic plate 50 is next attached to the lateral flanges 28*k* by threaded posts 50*a*, attached to the front surface of plate 50, which extend through the holes in Front magnetic plate 50 is provided with an insulating guide member 54 (FIG. 4) attached to the front face thereof by suitable fastener means (not shown). Guide 54 is provided with a hole 54*a* extending therethrough and aligned substantially parallel with the axis of plunger 36. The function of guide 54 will be described later herein.

Header 8 comprises power terminals 14 and 16 mounted thereon to extend therethrough. Terminals 14 and 16 are identical, and therefore only terminal 16 will be described. As best seen in FIG. 3; terminal 16 comprises a post having a cylindrical body 16*a* and a coaxially extending threaded shank 16*b*. An insulator 16*c* surrounds the post and is attached directly to header 8 within a hole in the header. The juncture of insulator 16*c* and header 8 at the hole is sealed continuously around the periphery of the insulator. As mentioned previously, the cylindrical body 16*a* of the terminal has an internally threaded hole in its end for receiving screw 17 for attaching a power supply conductor to the terminal. A jam nut 56 is threadably disposed on the threaded shank 16*b* for reasons that will be discussed hereinafter. The end of shank 16*b* is provided with an internally threaded opening for receiving a screw 58 when attaching a stationary contact conductor to the terminal post.

Figure 10:
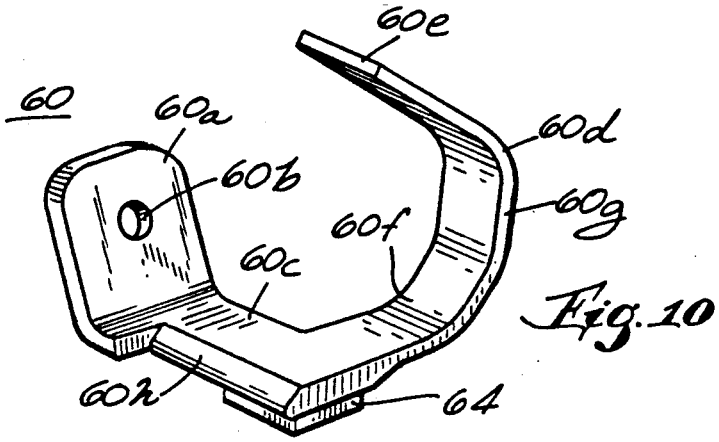
FIG. 10 is a perspective view of one stationary conductor of the switching apparatus of this invention.

The stationary contact conductors comprise L-shaped brackets 60, 62 made of good electrically conducting material such as heavy gauge copper which have stationary contact elements 64, 66 secured thereto, respectively. Inasmuch as both conductor brackets 60, 62 are made mirror-image identical, only bracket 60 will be described in detail with particular reference to FIG. 10. The upright leg 60*a* of the L-shaped bracket has a clearance hole 60*b* therethrough for the screw 58. As seen in FIG. 3, the upright leg of the bracket is bolted flush against the end face of the threaded shank of the respective terminal by the screw 58. Jam nut 56 is then turned tightly against the upright leg to further secure and stabilize the conductor bracket on the post. The horizontally extending leg 60*c* extends rearwardly, terminating in a laterally extending arc runner 60*d*. The arc runner has a generally upwardly curved shape wherein the distal end 60*e* is reversely directed with respect to the root end 60*f*. An intermediate straight section 60*g* separates the curved portions of the arc runner. The respective stationary contact element 64, 66 is brazed or otherwise secured to the under side of the L-shaped bracket at the juncture of the horizontal leg 60*c* and the laterally extending arc runner 60*d*. A beveled notch 60*h* is cut from the outboard edge of horizontal leg 60*c*.

A front insulating cover 68 is secured against a rear surface of magnetic plate 50 at the same time that L-shaped conductors 60, 62 are secured to the interior ends of terminals 14, 16, respectively. The arc runners 60*d*, 62*d* of the respective stationary contact conductors extend around the insulating cover 68 and bear against the rear surface thereof, forcing the insulating cover 68 tightly against the magnetic plate 50 when the screws 58 are tightened. Insulating cover 68 has structural profile features that complementally cooperate with features on the magnetic plate 50 to laterally and vertically position cover 68 on magnetic plate 50.

Figure 7:
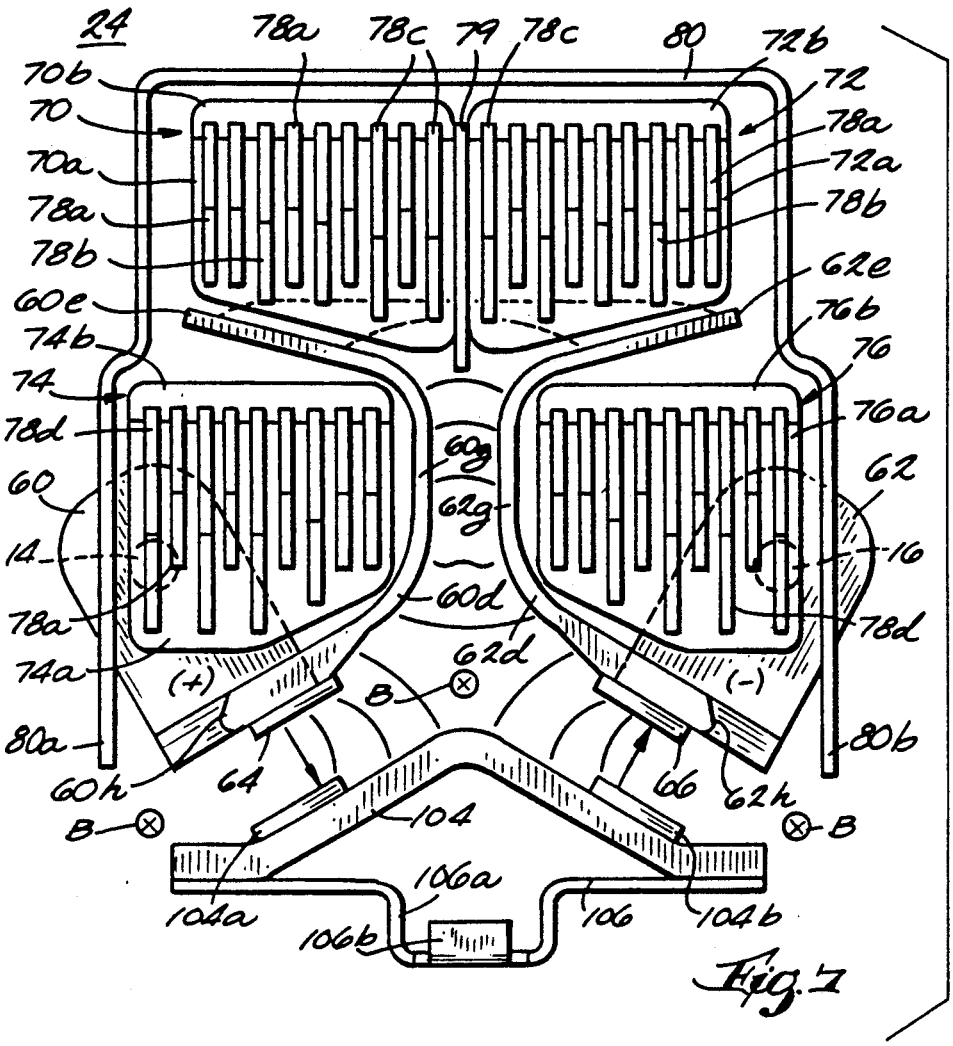
FIG. 7 is a generally schematic view of the arc extinguishing chambers of the bi-directional DC switching apparatus of this invention similar to FIG. 6, but showing arc movement for an opposite polarity of DC power supplied to the apparatus.
Figure 6:
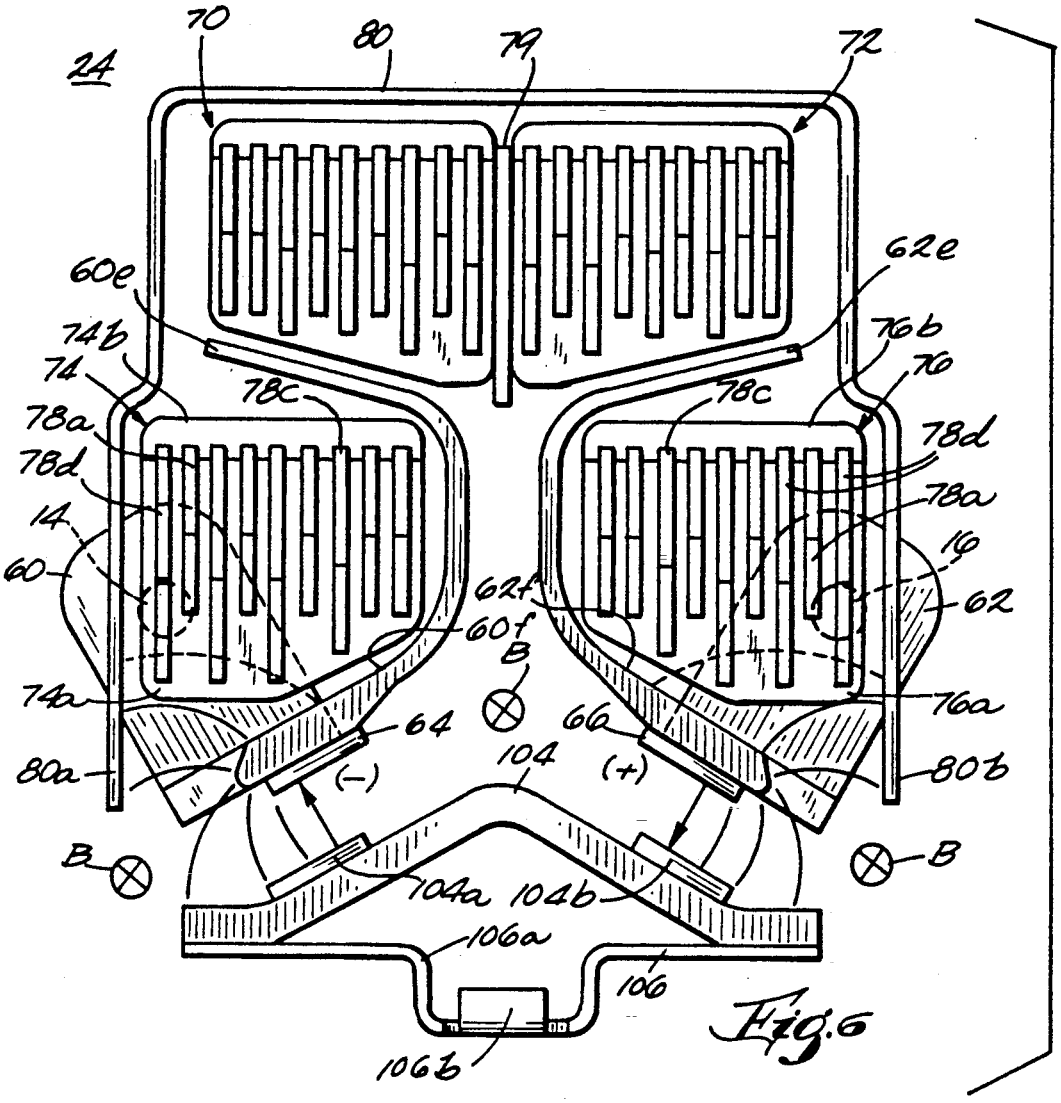
FIG. 6 is a generally schematic view of the arc extinguishing chambers of the bi-directional DC switching apparatus of this invention showing arc movement for one polarity of DC power supplied to the apparatus.

A plurality of splitter plate assemblies are positioned against the rear surface of front insulating cover 68 to provide first and second arc extinguishing chambers. The rear surface of insulating cover 68 is provided with shallow recesses which complementally conform to the profile of side plates of the splitter plate assemblies to laterally and vertically position these assemblies. A first arc extinguishing chamber comprises splitter plate assemblies 70 and 72 which are located end-to-end along the upper edge of cover 68. A second arc extinguishing chamber comprises a pair of splitter plate assemblies 74 and 76 which are disposed below the assemblies 70 and 72, respectively, but are spaced laterally apart, being located within the concave shape of arc runners 60*d* and 62*d*. Referring also to FIG. 5, each splitter plate assembly comprises a pair of slotted insulating side plates 70*a*, 72*a*, 74*a*, 76*a*, a plurality of flat conductive splitter plates 78*a*, 78*b*, 78*c* and 78*d* having opposite edges positioned and retained in the respective slots of the side plates in arrangements such as shown in FIGS. 6 and 7, and an insulating cap 70*b*, 72*b*, 74*b* and 76*b* disposed over upper edges of the splitter plates between the respective pairs of side plates. The insulating caps may be provided with a series of vent openings (not shown) which align with spaces between the respective splitter plates to permit arc gasses to escape from the respective arc extinguishing chambers. The insulated side plates 70*a*–76*a* are preferably formed of a fiberboard material commonly used for such purpose, although the splitter plates are preferably made of a non-magnetic material such as copper so as not to influence permanent magnet fields utilized in moving the arc as will be described later. The splitter plates are provided in four different lengths. The shorter length splitter plates 78*a* are generally disposed between adjacent ones of the longer splitter plates 78*b*, 78*c*, and 78*d*. Splitter plate assemblies 70 and 72 utilize assemblies 74 and 76 utilize splitter plates 78*a*, 78*c* and 78*d*. An additional splitter plate 79 is disposed between splitter plate assemblies 70 and 72 in the central arc chamber. Plate 79 is retained in position by a slot 68*a* (FIG. 4) in the rear surface of insulating plate 68 and by the adjacent edges of insulator plates 70*a* and 72*a*.

An inverted U-shaped conductive yoke 80 is positioned against the rear surface of insulating cover 68 wherein the bight portion of the yoke 80 spans the upper arc extinguishing chamber splitter plate assemblies 70 and 72 in proximity to the insulating caps 70*b* and 72*b* thereof. The opposite legs 80*a* and 80*b* of yoke 80 extend downwardly along outboard sides of the laterally spaced arc extinguishing chamber splitter plate assemblies 74 and 76. The distal ends of legs 80*a* and 80*b* are spaced outwardly from the respective horizontal legs of conductor brackets 60, 62 in the area of cut-out notches 60*h*, 62*h*. As seen in FIGS. 6 and 7, the arc extinguishing splitter plate assemblies 74 and 76 lie substantially within the outline defined by the concave side of arc runners 60*d*, 62*d*. Intermediate straight sections 60*g*, 62*g* of the arc runners provide additional vertical space and additional area within the concave outline to minimize the lateral spacing of the arc extinguishing splitter plate assemblies 74 and 76, thereby reducing the overall lateral dimension of the switching apparatus of this invention. The back, or concave surface of arc runners 60*d*, 62*d* cooperate with the inner surfaces legs 80*a* and 80*b* of yoke 80 to provide diverging conductors leading into the open lower end of the respective arc extinguishing splitter assemblies 74 and 76. The concave surface of the respective arc runners 60*d*, 62*d*, cooperatively provide a converging and subsequently diverging conductive path into the centrally located upper arc extinguishing chamber comprising splitter assemblies 70 and 72.

A rear insulating cover 82 is next disposed over the splitter plate assemblies and arc runners. The front surface of rear insulating cover 82 has shallow recesses similar to those described in the rear surface of front insulating cover 68 which conform to the profile of the respective splitter plate assemblies to position the cover 82 relative to the assemblies and vice versa. Cover 82 has an upper wall 82*a* overlying conductive yoke 80 and the upper edge of front insulating cover 68. Cover 82 also has forwardly extending side walls 82*b* and 82*c* which overlap side edges of front cover 68 over the majority of the height of cover 82. The side walls are notched at 82*d*, 82*e*, respectively, at the upper corners to accommodate rearwardly extending tabs 50*b* of front magnetic plate 50 and corresponding, mutually aligned forwardly extending tabs 84*a* of a rear magnetic plate 84. A plurality of permanent magnets 86, 88, 90, 92 and 94 are positioned on rear magnetic plate 84 in a star pattern as particularly shown in FIG. 2. The magnets are trapped between rear magnetic plate 84 and the rear surface of insulating cover 82 by clamping pressure provided by screws 96 extending through clearance holes in lateral tabs 84*b* of rear magnetic plate 84 and threading into tapped holes in corresponding tabs 50*c* of front magnetic plate 50. The permanent magnets 86–94 are polarized across the width thereof to establish a magnetic field B directed forwardly through the switching apparatus in the area of the arc extinguishing chambers and arc runners as may be seen in FIGS. 6 and 7. The magnetic plates 50 and 84 form a magnetic path around the outside of the switching apparatus and an air gap across the respective arc extinguishing chambers. The mutually aligned tabs 50*b* and 84*a* provide a controlled air gap in the outer magnetic path and may be made to abut if so desired. Moreover, screws 96 may further enhance the magnetic loop if made of magnetic steel or the like.

Figure 2:
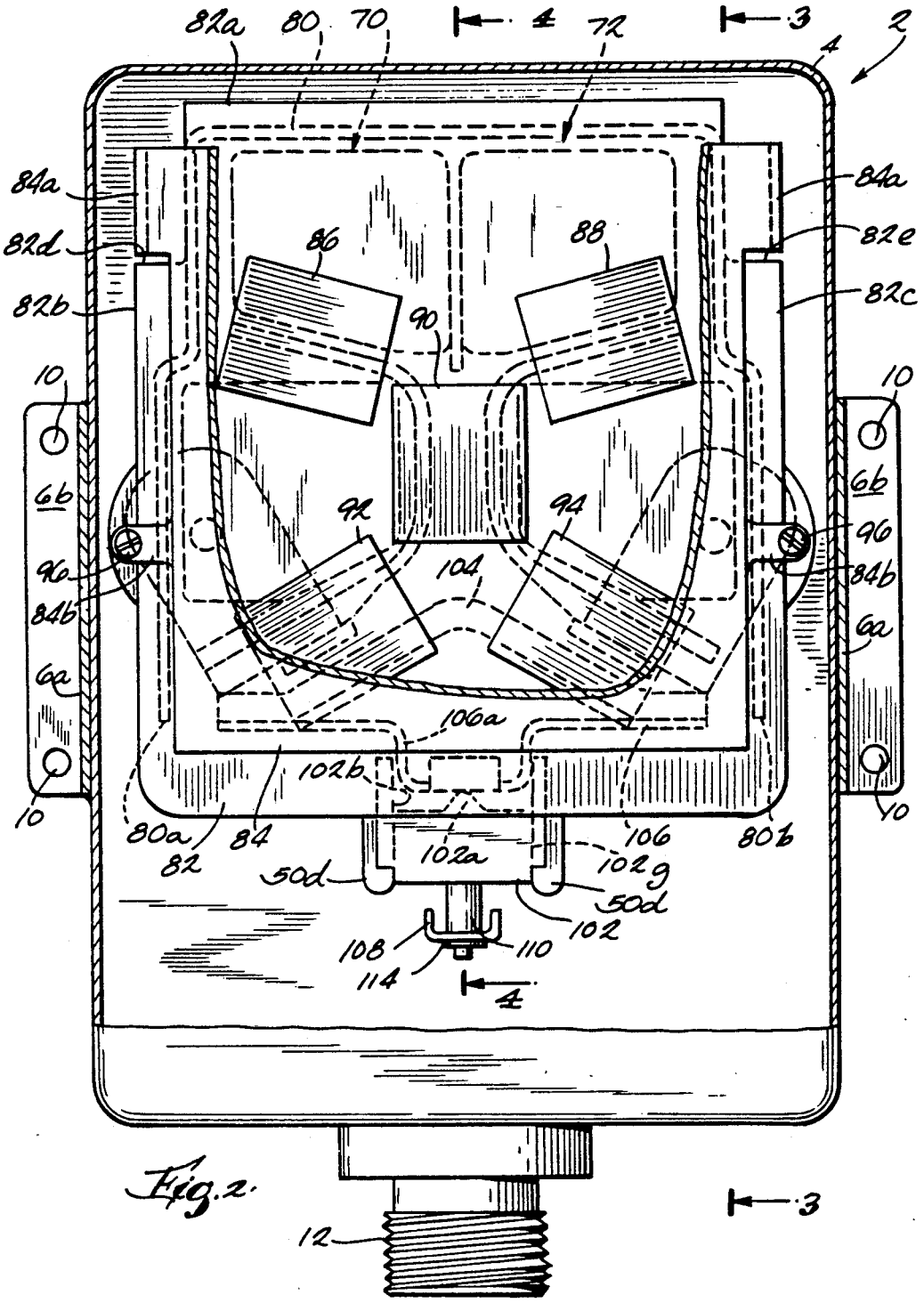
FIG. 2 is a back view of the contactor shown in FIG. 1 with the outer envelope broken away to expose the bi-directional DC switching apparatus of this invention.

A movable contact assembly indicated generally by the reference number 100 is assembled to the switching apparatus 24 and linear motor 26. The movable contact assembly comprises a molded insulating contact carrier 102 to which a movable contact 104 is pivotally mounted upon a fulcrum 102*a* of the carrier 102. An inverted V-shaped movable contact 104 has a tie plate 106 secured across outer ends thereof by suitable means such as riveting or the like. Tie plate 106 has a downwardly directed offset U-shaped center 106*a* which is received within a pocket 102*b* of the carrier 102 wherein fulcrum 102*a* is provided (FIG. 2). Movable contact 104 is held against fulcrum 102*a* by an insulating retainer 98 which overlies a pair of upstanding tabs 106*b* of tie plate 106. An opposite end of retainer 98 overlies a shelf portion 102*c* of contact carrier 102 (FIG. 4). Referring to FIGS. 2–4 and 8, a channel shaped drive link 108 is hooked to contact carrier 102 at the forward end thereof and extends rearwardly adjacent the lower surface of the contact carrier. Carrier 102 is provided with a hole 102*d* in the region of shelf 102*c* through which a pin 110 extends. The upper end of pin 110 is firmly secured in abutting relationship against the under side of retainer 98 by a screw 112 or other suitable fastener. The lower end of pin 110 is provided with a reduced diameter projection 110*a* which has an annular groove for receiving a C-clip 114 to firmly attach the pin 110 to the drive link 108. The forward end of drive link 108 is attached to the lower end of drive rod 34 which is provided with a reduced diameter projection 34*a* similar to projection 110*a* of pin 110. An annular shoulder formed by rod 34 and reduced diameter projection 34*a* abuts the upper surface of drive link 108. Projection 34*a* is provided with an annular groove which receives a C-clip 116 to firmly attach the lower end of drive rod 34 to drive link 108. A helical compression spring 118 is disposed around drive rod 34 between drive link 108 and contact carrier 102, biasing the drive link 108 downwardly away from carrier 102, thereby maintaining retainer 98 firmly seated against shelf 102*b* and holding movable contact 104 and its retainer 106 firmly in engagement with carrier 102 at fulcrum 102*a*. A guide rod 120 having a flanged lower end seats against an upper surface of contact carrier 102 and is secured firmly thereagainst by a screw 122 which extends through an opening in contact carrier 102 and threads into an internally threaded opening within the lower end of guide rod 120. The upper end of guide rod 120 extends into hole 54*a* of guide 54 to provide a second point of support for the movable contact assembly 100 parallel to the axis of plunger 36. The movable contact assembly 100 is also guided for vertical reciprocal movement by a pair of depending legs 50*d* (FIGS. 2 and 3) which define a slot 50*e* therebetween (FIGS. 2 and 4). Contact carrier 102 is provided with grooves 102*g* in lateral surfaces thereof which receive the legs 50*d* to further guide the movable contact assembly for reciprocal movement.

With the above described assembly of a the contact mechanism to the switching apparatus and the motor, and the entire assembly completed to the header, the can 4 is brought into position over the switching apparatus wherein the open end thereof nests within the flared rear edge of header 8. The juncture of can 4 with header 8 is welded entirely around the periphery to provide a hermetic seal. The flanges 8*a* and 6*b* are joined together by fasteners 10 such as rivets to provide increased integrity against mechanical damage to the welded joint. The interior of the envelope may be exhausted and filled with an inert gas through tube 22 which is pinched shut and otherwise sealed following completion of the process.

Operation of the switching apparatus of this invention will now be described. Power supply conductors (not shown) may be connected to terminals 14, 16 by screws 17. The polarity of the power supplied to the terminals is immaterial for this switching apparatus. The magnetic field B (FIGS. 6 and 7) directed through the respective arc extinguishing chambers is directed from the rear to the front as entering the plane of the paper when viewing FIGS. 6 and 7. The linear motor 26 is controlled from a remote location through multipin connector 12 to the electronics (not shown) of the contactor also housed within the envelope. When an appropriate coil 44 is energized, a magnetic pattern is created within the frame 28 which attracts plunger 36 against the upper wall **28*d* of frame 28. Once in this position, the permanent magnets 42 establish a holding path that maintains the plunger in the upper position after the coil is deenergized. In the upper position of plunger 36, drive rod 34 pulls drive link 38 upwardly which in turn drives contact carrier 102 upwardly by virtue of the resilient connection of spring 118 between drive link 108 and carrier 102. As movable contact elements 104*a* and 104*b* engage stationary contact elements 64 and 66, spring 118 compresses to provide contact closing pressure to the movable contacts. As spring 118 compresses, pin 110 is permitted movement relative to carrier 102 to move the retainer 98 upwardly away from movable contact 104**, thereby providing no counter forces to the contact.

A separate signal may be provided to an appropriate coil 44 to move the contactor switching apparatus to its open condition. Energization of an appropriate coil 44 establishes an opposite flux pattern in the frame 28 whereby the plunger 36 is attracted to the lower leg **28*e* of frame 28, thereby moving drive rod 34 to an extended position with respect to the motor assembly. In so doing, drive rod 34 drives the drive link 108 downwardly which in turn carries with it pin 110 and retainer 98 as well as carrier 102 by virtue of the hook at the forward end of drive link 108. This movement effects separation of the movable contact elements 104*a* and 104*b* from the stationary contact elements 64 and 66**, thereby establishing an electric arc between the movable and stationary contacts.

With reference to FIGS. 6 and 7, the polarity of the power supply connected to the switching apparatus will determine whether the centrally located arc chamber or the laterally spaced pair of outboard arc extinguishing chambers will be operational in interrupting the arc. Assuming the positive potential to be connected to terminal 16 and the negative potential to be connected to terminal 14 as shown in FIG. 6, current flowing in the arc will be from stationary contact element 66 to movable contact element **104*b*, through the movable contact 104 and from the other movable contact element 104*a* into stationary contact element 64. With the magnetic field B applied in the forward direction, i.e. into the paper, the magnetic field and current direction cooperate to provide forces on the arcs which drive the arcs laterally outwardly toward conductive yoke 80. As indicated in FIG. 6, the arc moves along the movable contact element, onto the movable contact, and then transfers to the respective leg of conductive yoke 80 to bridge the respective leg of the yoke and the beveled notch 60*h* or 62*h* of the respective L-shaped conductive bracket. The arc then moves upward along the respective leg of the conductive yoke and along the concave surface of the horizontal leg and arc runner of the respective L-shaped conductive bracket, causing the arc to be lengthened as it moves into the respective laterally spaced arc extinguishing chamber of splitter plate assemblies 74 or 76. The arc first moves into the lower splitter plates 78*d* and subsequently to the splitter plates 78*c* to separate the arc into smaller segments, thereby increasing the arc voltage. Each of these segments is ultimately separated into halves as the arc moves into the splitter plates 78*a*** to further drive up the arc voltage and drive the current in the arc to zero.

If the polarity of the power supply were connected in the reverse manner to the terminals 14 and 16, such as is shown in FIG. 7, then current in the arc flows from stationary contact element 64 to movable contact element **104*a*, through movable contact 104 to movable contact element 104*b* and to stationary contact element 66. With current directed in this manner and the magnetic field B forwardly directed into the paper, the combined effect of the current and magnetic field establish forces which direct the arcs laterally inwardly whereby the arc moves from the movable contact 104 to bridge the arc runners 60*d* and 62*d* of the respective conductive brackets 60 and 62. As seen in FIG. 7, the arc moves upwardly within the straight intermediate portions 60*g* and 62*g* of the arc runners and then into the divergent distal ends 60*e* and 62*e*. As the arc moves into the splitter plates of the centrally located arc chamber comprising splitter plate assemblies 70 and 72, it divides into several shorter arcs to raise the arc voltage in each shorter segment. Continued movement of the arc within the arc extinguishing chamber further divides the segments in half to drive the arc voltage even higher and the current in the arc to zero. Accordingly, the arc is either extinguished in the laterally spaced chambers comprising splitter plate assemblies 74 and 76 or in the central chamber comprising splitter plate assemblies 70 and 72**, according to the polarity of the power supply connection to the switching apparatus.

The unique stacked arrangement of the arc chambers and the coextensive of front-to-rear disposition of the arc chambers and the drive motor provide a particularly compact assembly capable of interrupting DC currents of large magnitude. The particular electromagnetic motor is readily and inexpensively manufactured and assembled with the various elements of the motor in precise alignment through a unique one piece frame for the motor. Although the contactor of this invention has been disclosed in a preferred embodiment, it is to be understood that it is susceptible of various modifications without departing from the scope of the appended claims.

We claim:

1. Bi-directional direct current switching apparatus comprising:

a spaced pair of arc extinguishing chambers;

a third arc extinguishing chamber centrally disposed relative to said spaced pair of arc extinguishing chambers;

a spaced pair of conductors connectable to a source of DC power, each conductor comprising a stationary contact and arc runner means leading from said contact to said third arc extinguishing chamber, said arc runner means being disposed between said spaced pair of arc extinguishing chambers;

conductive means spaced from said stationary contacts and extending along said spaced pair of arc extinguishing chambers at sides of respective said chambers opposite said arc runner means, said conductive means and said arc runner means providing respective divergent guides from said stationary contacts to said divergent guides from said stationary contacts to said spaced pair of arc extinguishing chambers;

a movable contact;

drive means operable to move said movable contact into and out of bridging engagement with said stationary contacts; and means providing a magnetic field across said apparatus in a region comprising said stationary contacts and said arc extinguishing chambers, said magnetic field having a magnetic flux density directed substantially normal to movement of said movable contact, said magnetic field and electric current in arcs established between said movable and stationary contacts generating forces which assist movement of said arcs in predetermined directions away from said stationary contacts into said third arc extinguishing chamber or into said spaced pair of arc extinguishing chambers according to polarity of said spaced pair of conductors when connected to said source of DC power.

2. The bi-directional direct current switching apparatus defined in claim 1 wherein said conductive means is electrically continuous.

3. The bi-directional direct current switching apparatus defined in claim 2 wherein said stationary and movable contacts, said conductors, said conductive means and said arc extinguishing chambers are disposed in a common plane.

4. The bi-directional direct current switching apparatus defined in claim 3 wherein said arc runner means comprises an elongated strip of a respective said conductor, said strip having a generally curved configuration, said conductors being arranged wherein respective said strips are disposed in a mirror image relation with convex sides facing each other, said strips terminating in divergent portions defining an edge of said third arc extinguishing chamber, and said spaced pair of arc extinguishing chambers being respectively located at concave sides of said strips, a back surface of said strip defining an edge of a respective one of said spaced pair of arc extinguishing chambers.

5. The bi-directional direct current switching apparatus defined in claim 4 wherein said strips have straight intermediate portions extending in spaced parallel relation away from said stationary contacts, and said spaced pair of arc extinguishing chambers are disposed substantially within an area proscribed by said concave side of said strip, thereby providing a compact lateral dimension for said apparatus.

6. The bi-directional direct current switching apparatus defined in claim 5 wherein said arc extinguishing chambers, said arc runner strips of said conductors, and said stationary and movable contacts are disposed within an insulating housing, and said means providing said magnetic field comprises ferrous plates disposed against opposite exterior surfaces of said housing having portions enveloping said housing to form a magnetic loop around said housing, and permanent magnet means adjacent at least one of said ferrous plates.

7. The bi-directional direct current switching apparatus defined in claim 6 wherein said drive means comprises an electromagnetically operated linear motor attached against one of said ferrous plates, said motor comprising an axially reciprocally movable plunger movable parallel to movement of said movable contact, and means coupling said movable contact to said plunger comprising a contact carrier having said movable contact mounted thereon, said carrier being guided for linear reciprocal movement, and means resiliently coupling said carrier to said plunger.

8. The bi-directional direct current switching apparatus defined in claim 7 wherein said means resiliently coupling said carrier to said plunger comprises a drive link disposed proximate said carrier, said plunger comprising an extension projecting through a clearance hole in said carrier for axial movement relative thereto, abutment means on a distal end of said plunger fixing said drive link on said plunger, spring means biasing said drive link and said carrier apart, and hook means on said drive link overlying said carrier limiting separation of said carrier and drive link by said spring means.

9. The bi-directional direct current switching apparatus defined in claim 8 wherein said drive link comprises an upstanding pin axially parallel to said plunger extending through a clearance hole in said carrier, a member affixed to a distal end of said pin overlying said movable contact and holding said movable contact to said carrier by said spring bias, said pin further cooperating with said plunger and said hook guiding said drive link for movement relative to said carrier.

10. The bi-directional direct current switching apparatus defined in claim 9 wherein said carrier comprises an upstanding pin axially parallel to said plunger and laterally spaced therefrom, said pin being guided for axial reciprocal movement relative to said housing to prevent window locking of said carrier when driven by said plunger.

11. The bi-directional direct current switching apparatus defined in claim 10 wherein said carrier is further guided for linear reciprocal movement by slots in lateral edges of said carrier slidingly received over corresponding depending legs of said one ferrous plate.

12. Bi-directional direct current switching apparatus comprising:

a current interrupter module comprising a pair of stationary contacts and a movable contact linearly reciprocally movable in a first plane into and out of bridging engagement with said stationary contacts;

an electromagnetically operable motor mounted alongside said interrupter module, said motor having a linearly movable armature reciprocally movable in a second plane, said second plane being parallel to and laterally spaced from said first plane; and means coupling said armature to said movable contact.

13. The bi-directional direct current switching apparatus defined in claim 12 wherein said current interrupter module comprises:

a pair of generally C-shaped conductors laterally spaced in a mirror image relationship with respective convex surfaces facing each other, said stationary contacts being respectively mounted on a convex surface of a lower leg of respective said C-shaped conductors;

a central arc extinguishing chamber disposed adjacent upper legs of said C-shaped conductors;

a pair of laterally spaced arc extinguishing chambers respectively disposed adjacent a concave surface of respective said lower legs of said C-shaped conductors;

conductive means disposed along sides of said pair of arc extinguishing chambers opposite said lower legs, said conductive means being laterally spaced from an end of said lower leg of respective said C-shaped conductors, said conductive means being electrically continuous;

terminal means connected to said conductors connectable to a source of DC power; and means providing a magnetic field having a magnetic flux density directed across said module perpendicular to said first plane, said magnetic field and electric current in arcs established between said movable and said stationary contacts generating forces which assist movement of said arcs in predetermined directions away from said stationary contacts into said central arc extinguishing chamber or into said pair of laterally spaced arc extinguishing chambers according to polarity of said pair of conductors when connected to said source of DC power.

14. The bi-directional direct current switching apparatus defined in claim 13 wherein said C-shaped conductors are elongated by generally straight portions between said upper and lower legs, said straight portions extending substantially parallel toward said central arc extinguishing chamber, thereby providing increased area adjacent said concave surface of respective said conductors for said respective laterally spaced arc extinguishing chambers without increasing an overall lateral dimension of said module.

15. The bi-directional direct current switching apparatus defined in claim 14 wherein said arc extinguishing chambers each comprise a plurality of non-ferrous spaced arc splitter plates defining spaces therebetween open to a respective adjacent leg of said C-shaped conductors.

16. The bi-directional direct current switching apparatus defined in claim 14 wherein said magnetic field is provided by permanent magnet means disposed in proximity to said C-shaped conductors.

17. The bi-directional direct current switching apparatus defined in claim 16 further comprising:

a pair of insulating covers disposed across said arc extinguishing chambers, conductors, and conductive means at front and rear surfaces thereof, respectively;

a pair of magnetic plates secured against faces of said covers, one of said plates having said permanent magnet means attached thereto disposed between said one plate and a respective said cover, said magnetic plates including means magnetically interconnecting said plates to form a magnetic path around said module.

18. The bi-directional direct current switching apparatus defined in claim 17 wherein said electromagnetically operable motor comprises:

a one-piece magnetic frame attached to an other of said magnetic plates, said frame having upper and lower end walls disposed perpendicularly to said second plane;

a pair of coils having cylindrical openings disposed axially end-to-end between said upper and lower end walls along said second plane; and wherein said armature comprises a cylindrical plunger axially movable within said openings.

19. The bi-directional direct current switching apparatus defined in claim 18 wherein said coils comprise molded insulating bobbins, respective adjacent ends of said coils having cylindrical sleeves projecting therefrom around said opening, said sleeves extending into a complemental opening of a discrete alignment member disposed between said adjacent ends to maintain said openings of said coils coaxially aligned.

20. The bi-directional direct current switching apparatus defined in claim 19 wherein said lower end wall of said frame has a hole having a smaller diameter than said plunger, and said means coupling said armature to said movable contact comprises a non-magnetic pin extending through said hole in said lower end wall and attached to said plunger.

21. The bi-directional direct current switching apparatus defined in claim 20 wherein said means coupling said armature to said movable contact further comprises a contact carrier having said movable contact mounted thereon, said carrier being guided for linear reciprocal movement in said first plane, and means comprising a resilient connection between said carrier and said pin.

22. The bi-directional direct current switching apparatus defined in claim 21 wherein said resilient connection comprises a drive link disposed below said carrier, said pin extending through clearance holes in said carrier and said drive link for relative axial movement therebetween, said pin having an enlarged head maintaining said drive link secured thereon, a spring disposed between said drive link and said carrier biasing said carrier away from said drive link, and hook means on said drive link overlying said carrier, limiting separation of said carrier and said drive link.

23. The bi-directional direct current switching apparatus defined in claim 22 wherein said drive link comprises an upstanding projection rigid therewith extending through an aligned clearance opening in said carrier, said projection having a clamp member overlying said movable contact, biasing said movable contact against said carrier by said spring.

24. The bi-directional direct current switching apparatus defined in claim 23 wherein said other magnetic plate comprises a pair of opposed edges extending parallel to said first plane and said carrier comprises a pair of slots at lateral edges thereof complementally disposed around said opposed edges for guiding said carrier for linear reciprocal movement along said first plane.

25. The bi-directional direct current switching apparatus defined in claim 24 wherein said carrier comprises an upstanding pin axially parallel to said first and second planes, said pin being guided relative to said housing to prevent window locking of said carrier when driven by said motor.

* * * * *